US009963208B2

(12) United States Patent
Hansen

(10) Patent No.: US 9,963,208 B2
(45) Date of Patent: May 8, 2018

(54) WATERCRAFT STABILIZING MEMBER WITH FOAM CORE AND NON-COMPRESSIVE BLADDER

(71) Applicant: William M. Hansen, Port Orchard, WA (US)

(72) Inventor: William M. Hansen, Port Orchard, WA (US)

( * ) Notice: Subject to any disclaimer, the term of this patent is extended or adjusted under 35 U.S.C. 154(b) by 0 days. days.

(21) Appl. No.: 15/002,217

(22) Filed: Jan. 20, 2016

(65) Prior Publication Data

US 2016/0214682 A1 Jul. 28, 2016

Related U.S. Application Data

(60) Provisional application No. 62/106,656, filed on Jan. 22, 2015.

(51) Int. Cl.
*B63B 43/14* (2006.01)

(52) U.S. Cl.
CPC ..... *B63B 43/14* (2013.01); *B63B 2043/145* (2013.01)

(58) Field of Classification Search
CPC ... B63B 43/14; B63B 2043/145; B63B 59/02; B63B 2059/025; E02B 3/26
See application file for complete search history.

(56) References Cited

U.S. PATENT DOCUMENTS 2,391,906 A 1/1946 Kearny
4,351,257 A * 9/1982 Brown, Jr. ..... B63B 59/02 114/219
5,282,436 A 2/1994 Hansen
5,878,685 A * 3/1999 Hemphill ..... B29C 44/569 114/219
7,201,865 B2 4/2007 Hansen
2004/0069203 A1* 4/2004 Fleming ..... B63B 59/02 114/345
2004/0083941 A1 5/2004 Hansen
2008/0196652 A1 8/2008 Hu
2009/0049757 A1 2/2009 Potter
2011/0247542 A1* 10/2011 Jones ..... B63B 1/04 114/283
2013/0118395 A1 5/2013 Cross
2014/0202370 A1* 7/2014 Smith ..... B63B 43/14 114/345

OTHER PUBLICATIONS

International Search Report and Written Opinion dated Apr. 11, 2016, issued in corresponding International Application No. PCT/US2016/014184, filed Jan. 20, 2016, 9 pages.

* cited by examiner

*Primary Examiner* — Andrew Polay
(74) *Attorney, Agent, or Firm* — Christensen O'Connor Johnson Kindness PLLC

(57) ABSTRACT

Outboard stabilizing members (110, 210, 310, 410) include a foam core (120, 220, 320, 420) and a bladder (134, 234, 334, 434) configured to be inflated to a design pressure and configured to cover at least a portion of the associated foam core. The bladders are configured to be non-compressive to the foam core. A plurality of joining members (135, 235, 335, 435) connect an inner wall of the bladder with an outer wall of the bladder, such that when the bladder is inflated to the design pressure the outer wall and joining members prevent the inner wall from compressing the foam core. The joining members are preferably inelastic, and may be one-dimensional linear members such as strings or rods, two-dimensional panels, or other webbing.

17 Claims, 5 Drawing Sheets

WATERCRAFT STABILIZING MEMBER WITH FOAM CORE AND NON-COMPRESSIVE BLADDER

CROSS-REFERENCE TO RELATED APPLICATION

This application claims the benefit of Provisional Application No. 62/106,656, filed Jan. 22, 2015, the entire disclosure of said application is hereby incorporated by reference herein.

BACKGROUND

Watercraft that incorporate foam with the hull of a watercraft are known in the art, for example, in U.S. Pat. No. 4,060,865, to Woolworth. Typically, foam is incorporated and enclosed within the hull structure itself. These boat designs are generally safer than designs that do not incorporate flotation devices within the hull. Outboard flotation members mounted to the sides of a boat are also known in the art. For example, in U.S. Pat. No. 4,287,624, to Lowther, foam flotation devices are attached to the exterior and interior of a low-speed fishing boat.

In U.S. Pat. No. 5,282,436, to Hansen, the present inventor discloses outboard foam stabilizing members suitable for use on high-performance watercraft. Hansen discloses a watercraft having a rigid, planing hull and exterior foam stabilizing members that extend substantially around the perimeter of the boat hull. The foam stabilizing members are configured to remain substantially out of contact with the surface of the water when the boat is at cruising speed, so that the foam stabilizing members do not contribute to the wetted surface area of the watercraft while planing. The foam stabilizing members also act as a running surface when a sharp turn is performed at high speed.

In U.S. Pat. No. 6,810,827, to Hansen, a watercraft with an outboard stabilizing member (or collar) that combines inflatable inboard and outboard air bladders with a foam member disposed between the inboard and outboard bladders is disclosed. Other stabilizing collars that combine air bladders and foam members are disclosed in U.S. Pat. No. 7,201,865, to Hansen, and in U.S. Pat. No. 6,371,040, to Hemphill et al.

In some embodiments the outboard stabilizers extend from the side sheets along substantially the entire length of the watercraft, from bow to stern. Alternatively, outboard stabilizers may extend along only a portion of the vessel side sheets. The outboard stabilizers must be securely fixed to the watercraft because outboard stabilizers are subject to very significant hydrodynamic forces, especially on high-performance watercraft. It is important for the integrity of the vessel that outboard stabilizers be fastened securely to the watercraft.

Outboard stabilizing members that combine air bladders and foam members have become popular because they provide advantages over prior art air-only or foam-only stabilizing members. For example, air-only stabilizing members may become entirely ineffective if they are punctured due to loss of air. Foam-only stabilizing members, on the other hand, are typically difficult to remove. Removal of the stabilizers for conventional watercraft may be desirable, for example, to facilitate trailering or otherwise transporting the watercraft. Typically the air bladders and/or foam members are enclosed in a collar or sheath for attachment to the watercraft.

However, a disadvantage of conventional outboard stabilizing members that combine air bladders and foam members is that the foam members are compressed by the air bladders. The polymeric foams used for stabilizing members will shrink or compress when an external compressive force is applied. In fact, this property of the foam is often utilized to facilitate assembly of the stabilizing members. However, compression of the foam members during use may cause the foam members to become loose in the stabilizing member assembly. In order to compensate for the smaller foam members, a user may inflate the bladder(s) further, thereby reapplying a compressive force on the foam member and causing the foam member to shrink further. Compressive shrinking of the foam may cause the collar to take on an undesirable shape and/or interfere with the attachment mechanism for the stabilizing members. In particular, the compressed foam members will provide less buoyancy.

This could be catastrophic, in particular if the air bladders are punctured, for example, in an accident event in which the foam members are relied on to keep the vessel afloat. The polymeric foam member may retain its compressed shape and volume for hours after the compressive force has been removed. Therefore, in an accident scenario wherein the air bladder has overly compressed the foam member and then deflated in a catastrophic event, the smaller compressed foam member will not provide the buoyancy that it was designed to provide.

One challenge that has limited broader adoption of outboard stabilizers for high-performance watercraft is the additional maximum width, or beam, that results from outboard stabilizers. Watercraft may often be towed or otherwise transported over highways to a desired launch site. Highways generally have limitations on allowable vehicle width. For example, in the United States federal law sets a maximum commercial vehicle width of about 102 inches on the national network of highways (without special over-width permits) in 23 CFR Part 658.

In order to increase the usable interior space of a towable watercraft having outboard stabilizers, it would be beneficial if the outboard stabilizers could be decreased in size or easily removed for transporting or towing the vessel, and easily and quickly reinstalled or expanded when the vessel arrives at the desired launching location. Prior art attachment mechanisms for outboard stabilizers typically require many hours and trained personnel to remove and reinstall. Such removal and installation may also require special tools and the like. There is a need for improved methods and systems for attaching outboard stabilizers to watercraft.

There is also a need for an air/foam stabilizing member that can be repaired in situ. It would be beneficial to provide a stabilizing member with separable air bladders that can be quickly removed, repaired, and replaced without removing the buoyant stabilizing member from the watercraft, such that the foam members' contribution to the buoyancy of the stabilizing member is retained during the repair or maintenance.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

An outboard stabilizing member for a watercraft includes a foam core having an outer surface and an inflatable bladder having (i) an inner wall portion that overlies at least part of the foam core outer surface, (ii) an outer wall portion, and (iii) a plurality of members that connect the inner wall portion to the outer wall portion. The inflatable bladder is configured to be inflated to a design pressure, for example, a pressure between 1 psig and 40 psig, without producing a compressive force on the foam core.

In an embodiment, the outboard stabilizing member includes a sheath that covers the bladder and removably attaches to the watercraft.

In an embodiment, the plurality of joining members are inelastic and are located at spaced locations along the inner and outer wall portions of the bladder, such that the outer wall portion prevents the inner wall portion from exerting a compressive force on the foam core when the bladder is inflated.

In an embodiment, the inelastic joining members are panels or are webbing that define a plurality of channels within the bladder.

In another embodiment, the inelastic members are a plurality of strings or rods, which may be spaced evenly throughout the bladder.

In an embodiment, the plurality of strings or rods are all approximately the same length. In another embodiment, the strings or rods have a variety of lengths.

In an embodiment, the foam core is formed from a plurality of foam sub-members that extend from a first end of the foam core to a second end of the foam core. In a particular embodiment, at least one of the foam sub-members is wedge-shaped.

In an embodiment, the foam core has a D-shaped cross section.

In an embodiment, the outboard stabilizing member includes a second inflatable bladder having an inner wall portion and an outer wall portion, wherein the second bladder is configured to be inflated to the design pressure without applying a compressive force to the foam core, and the first and second bladders are positioned on opposite sides of the foam core.

In another embodiment, the bladder is configured to encircle the foam core.

A watercraft comprises a planing hull with port and starboard side sheets and includes at least one motor attached to the hull. A port stabilizing member, such as any of the embodiments described above is attached outboard to the port side sheet, and a corresponding starboard stabilizing member is attached outboard to the starboard side sheet. The stabilizing members each include a foam core and an inflatable bladder having an inner wall portion, an outer wall portion, and a plurality of connecting members that connect the inner wall portion to the outer wall portion. The bladder is configured to engage and at least partially encircle a portion of the associated foam core, such that when the bladder is inflated to a design pressure it does not exert a compressive force on the foam core. In an embodiment, the foam core and bladder of each stabilizing member is removably attached to the watercraft with a sheath.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
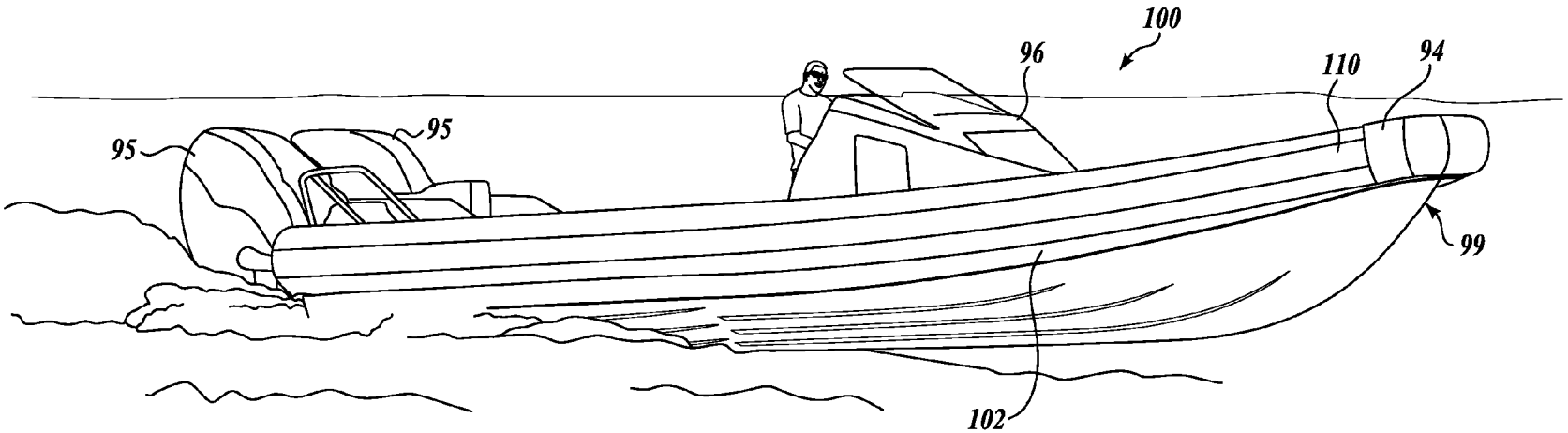
FIG. 1 is a perspective view of a watercraft having outboard stabilizers in accordance with the present invention.

A watercraft 100 in accordance with the present invention is shown in FIG. 1. The watercraft 100 includes a planing hull 99 having oppositely disposed port and starboard outboard stabilizing members 110 (only starboard stabilizing member 110 visible). In this particular embodiment, the outboard stabilizing members 110 extend longitudinally along all or most of the length of the planing hull 99, and are securely attached to the hull side sheets 102.

The stabilizing members 110 are disposed on the upper portion of the side sheets 102, such that the stabilizing members 110 do not engage the water when the watercraft 100 is planing and travelling straight ahead. If the watercraft 100 heels sufficiently, for example, during high-speed turns, or the like, or due to weather and/or water conditions, one or both of the stabilizing members 110 may engage the water to thereby provide additional buoyancy. For example, during high-speed turns the stabilizing member 110 on the heel side may provide a buoyancy force countering the heeling forces.

In the embodiment of FIG. 1, the watercraft in this embodiment includes a control console 96 and one or more outboard motors 95. Other watercraft configurations are clearly contemplated, without departing from the present invention as will be apparent to persons of ordinary skill in the art. For example, the present invention may be used in watercraft having inboard or sterndrive propulsion systems, and with a cabin cockpit or the like.

Figure 2:
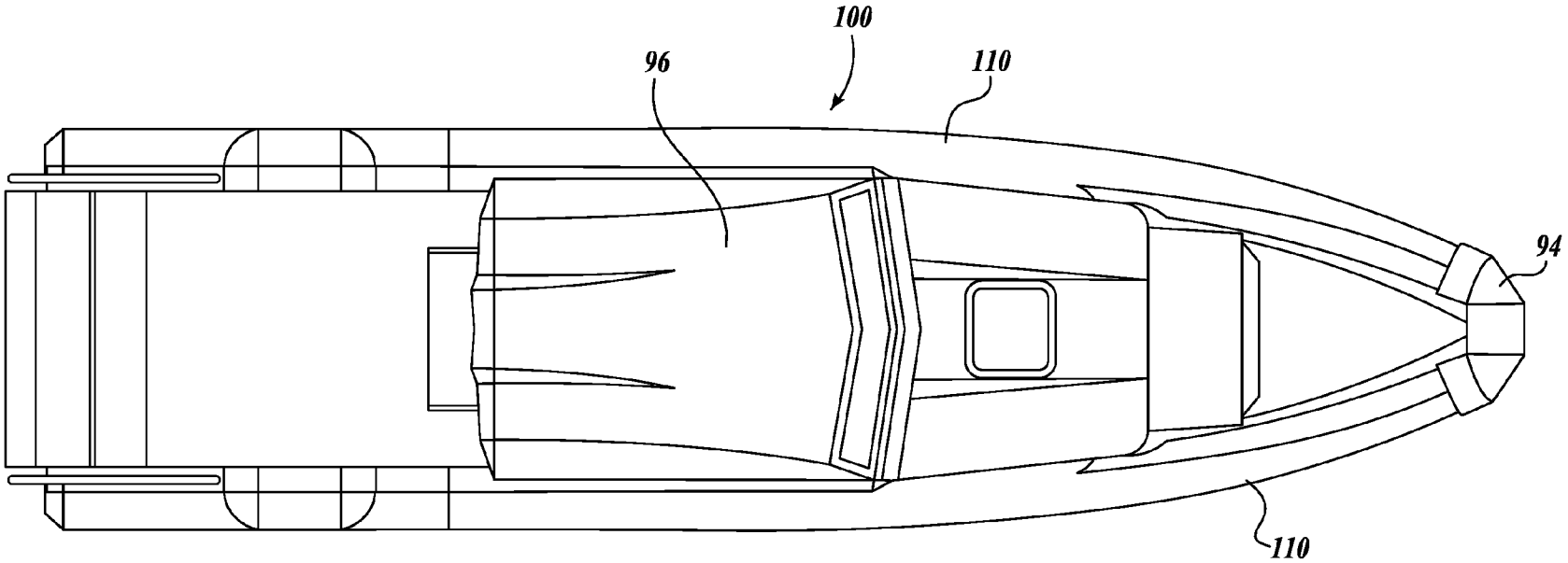
FIG. 2 is a plan view of the watercraft of FIG. 1.

FIG. 2 is a plan view of the watercraft 100. The front end of the stabilizing member 110 in this embodiment is configured to be received into a receiver 94, for example, a bow wrap securely fixed to the bow of the watercraft 100. It is contemplated that the stabilizing member 110 may be enclosed in a sheath or the like, to facilitate removable attachment to the watercraft 100.

Figure 3:
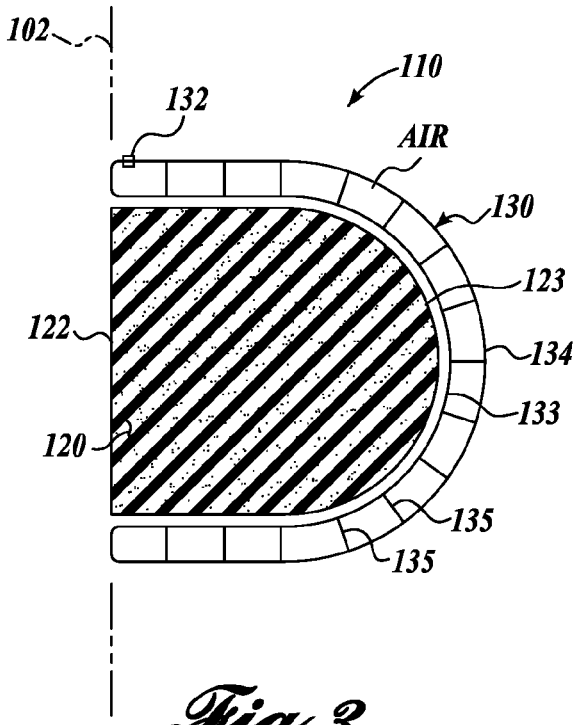
FIG. 3 is a cross-sectional view of an outboard stabilizer in accordance with the present invention.

A cross-sectional view of a first embodiment for the stabilizing member 110 is shown in FIG. 3. In this embodiment, the stabilizing member 110 includes a foam core member 120 that in this embodiment is generally D shaped in cross section. Other cross-sectional shapes may be used, including, for example, circular, polygonal, or oval cross sections. In this embodiment, the foam core member 120 has an inboard flat face 122 that may be positioned and shaped to abut the watercraft side sheet 102 and a curved outer face 123. Although the foam core member 120 is shown as a solid member, it is contemplated that it may alternatively include apertures, cavities, or other vacancies. For example, the foam core member 120 may alternatively be partially hollow. In another embodiment the foam core member 120 is formed in a number of different pieces or segments. For example, the foam core member 120 may be formed in two or more segments that abut or interlock end-to-end. In another embodiment, the foam core member 120 may comprise a plurality of elongate members that are positioned side-by-side, and may optionally be adhered or banded together.

A pliable and inflatable U-shaped bladder 130 is disposed about the curved outer face 123 of the foam core member 120. As discussed in more detail below, the U-shaped bladder 130 is configured such that it does not apply any significant compressive force to the foam core member 120. As used herein, an inflatable bladder that is configured to wrap at least partially around a foam core member, and to apply no significant compressive force to the foam core member when the bladder is inflated to a design pressure, is referred to as a non-compressive bladder. The bladder 130 includes a port or valve 132 that is configured for inflating the bladder 130. Typically, the bladder 130 will be inflated with air, although any other suitable inflating gas may alternatively be used.

The bladder 130 includes an inner wall portion 133 that generally follows the foam core curved outer face 123 and an outer wall portion 134. The bladder 130 further includes a plurality of spaced-apart joining members 135 (15 shown) that connect the inner wall portion 133 to the outer wall portion 134. The joining members 135 are spaced apart throughout the bladder 130, and are configured to limit the separation between the inner wall portion 133 and the outer wall portion 134. In this embodiment, the joining members 135 are all approximately the same length, such that the bladder 130 defines a bladder having a uniform thickness.

When the bladder 130 is fully inflated to a design pressure, for example, between 1 psig and 40 psig, the inner wall portion 133 and the outer wall portion 134 are uniformly spaced apart, and the outer wall portion 134 prevents the inner wall portion 133 from applying a significant pressure to the foam core member 120. Preferably the joining members 135 are substantially inelastic in the range of the design forces resulting from inflation of the bladder 130. The joining members 135 may be rigid but are preferably pliable.

Although in the illustrated embodiment the joining members 135 in the bladder 130 are generally uniformly spaced connectors, it is contemplated that the joining members may be formed as linear members, e.g., strings or rods, that are uniformly distributed throughout the bladder 130. Alternatively, the joining members 135 may be elongate panels or webbing that extend along the length of the bladder 130, thereby dividing the bladder 130 into a plurality of channels. The elongate panels 135 may be configured with end openings (not shown) such that the channels are in fluid communication, or alternatively may define sections that are not fluidly connected (e.g., with separate valves 132 to permit pressurizing the channels independently).

Figure 4:
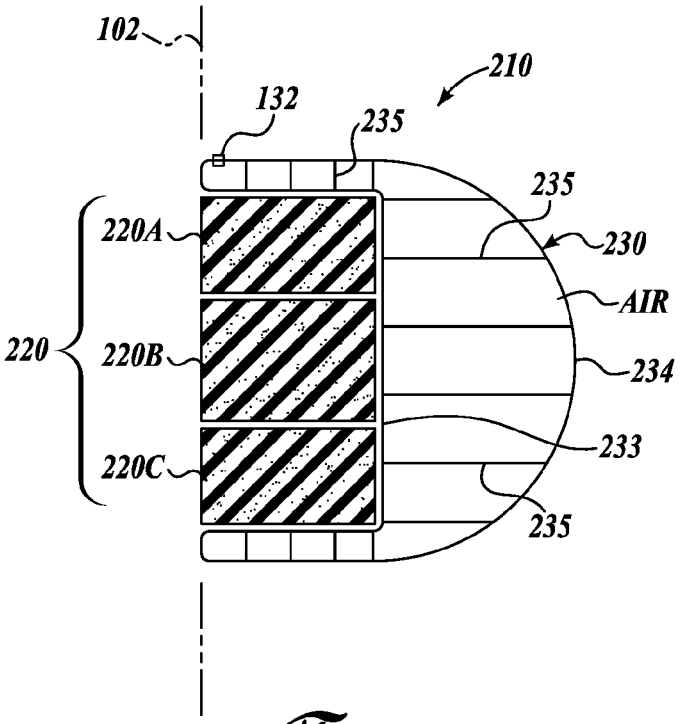
FIG. 4 is a cross-sectional view of another embodiment of an outboard stabilizer in accordance with the present invention.
Figure 5:
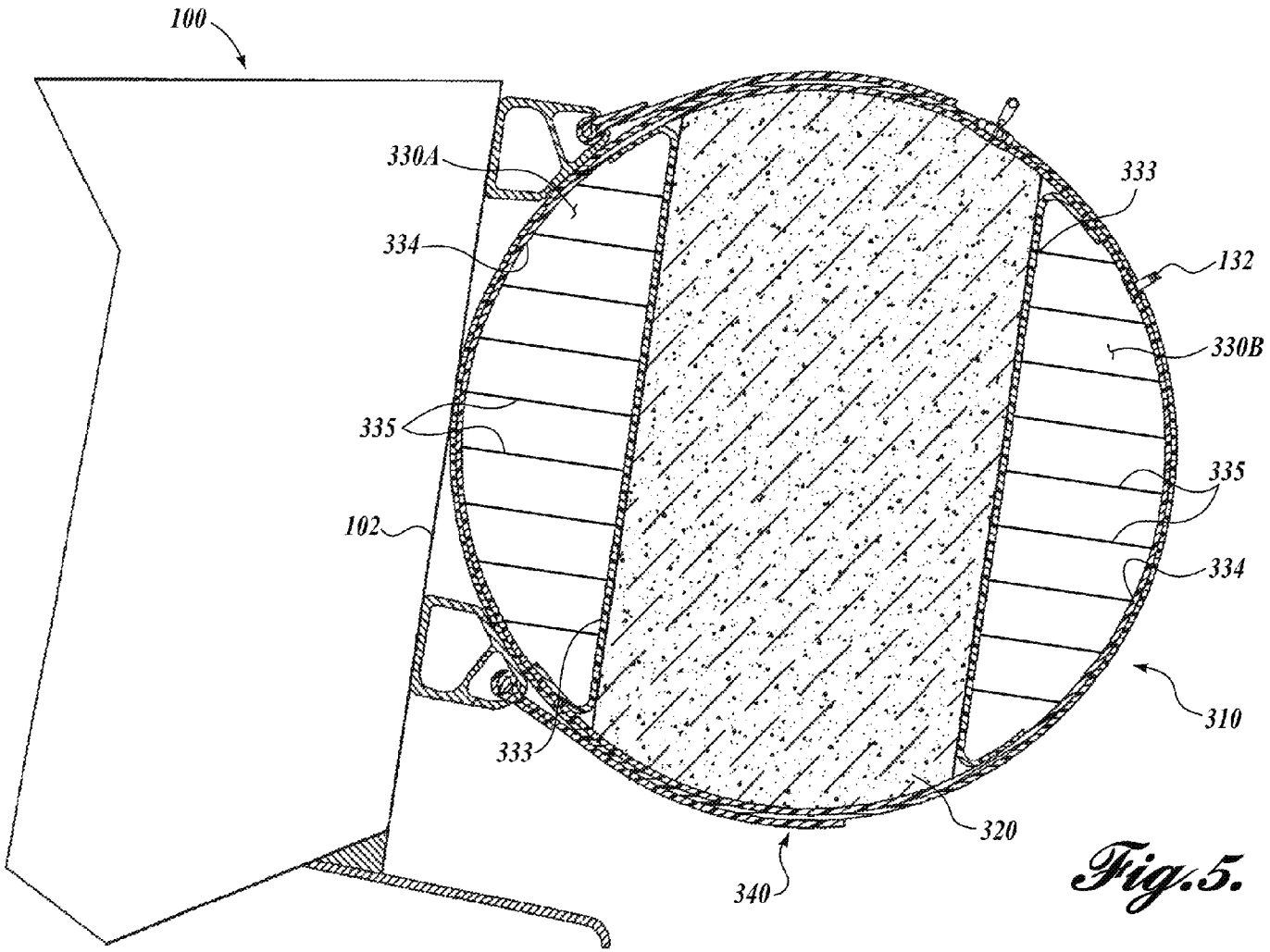
FIG. 5 is a cross-sectional view of another embodiment of an outboard stabilizer in accordance with the present invention.

A cross-sectional view of another embodiment of a stabilizing member 210 in accordance with the present invention is shown in FIG. 4. In this embodiment, the stabilizing member 210 includes a foam core 220 and a bladder 230. The foam core 220 is formed as a plurality of separable elongate foam members 220A, 220B, 220C that are generally rectangular in cross section. The bladder 230 includes an inner wall portion 233 that is shaped to approximately correspond to the foam core member 220, and an outer wall portion 234 that may be shaped similar to the outer wall portion 134 shown in FIG. 3. Joining members 235 connect the inner wall portion 233 to the outer wall portion 234. The joining members have different lengths to provide the desired shape, and are configured such that when the bladder 230 is fully inflated to the design pressure the inner wall portion 233 does not apply a compressive force to the foam member 220A, 220B, 220C.

Forming the foam core 220 in a plurality of elongate components 220A, 220B, 220C facilitates removing and reassembling the foam core 220, which may be easily accomplished by first partially or fully deflating the bladder 230. In some embodiments the foam members 220A, 220B, 220C may include a low-friction coating or panel between adjacent members 220A, 220B, 220C.

It will also be appreciated that the bladder 230 may be partially or fully deflated, without removing any portion of the stabilizing member 210 from the watercraft. This may be advantageous, for example, to reduce the total width of the watercraft 100 when trailering or otherwise transporting the watercraft 100. The bladder 230 may then be re-inflated when the watercraft is ready for operation.

A cross-sectional view of another embodiment of a stabilizing member 310 in accordance with the present invention is shown in FIG. 4, which is an improvement of the stabilizer disclosed in U.S. Pat. No. 6,810,827, to Hansen (referenced above). In this embodiment, the stabilizing member 310 includes an elongate foam core 320 that is approximately rectangular in cross section with rounded end faces. The stabilizing member 310 includes inner and outer bladders 330A, 330B, respectively. The bladders 330A, 330B each include an inner wall portion 333 that overlies one side of the foam core 320, and an outer wall portion 334 that provides a desired shape, for example, to define a stabilizing member 310 that is approximately a circular cylinder. A plurality of substantially inelastic joining members 335 connect the inner wall portions 333 to the outer wall portion 334. The joining members 255 have different lengths to accommodate the desired shape of the stabilizing member 310, and are configured such that when the bladders 330A, 330B are pressurized to the design pressure the inner wall portions 333 do not apply a compressive force to the foam core 320. A mounting and sheath assembly 340 attaches the stabilizing member 310 to the watercraft 100.

Figure 6A:
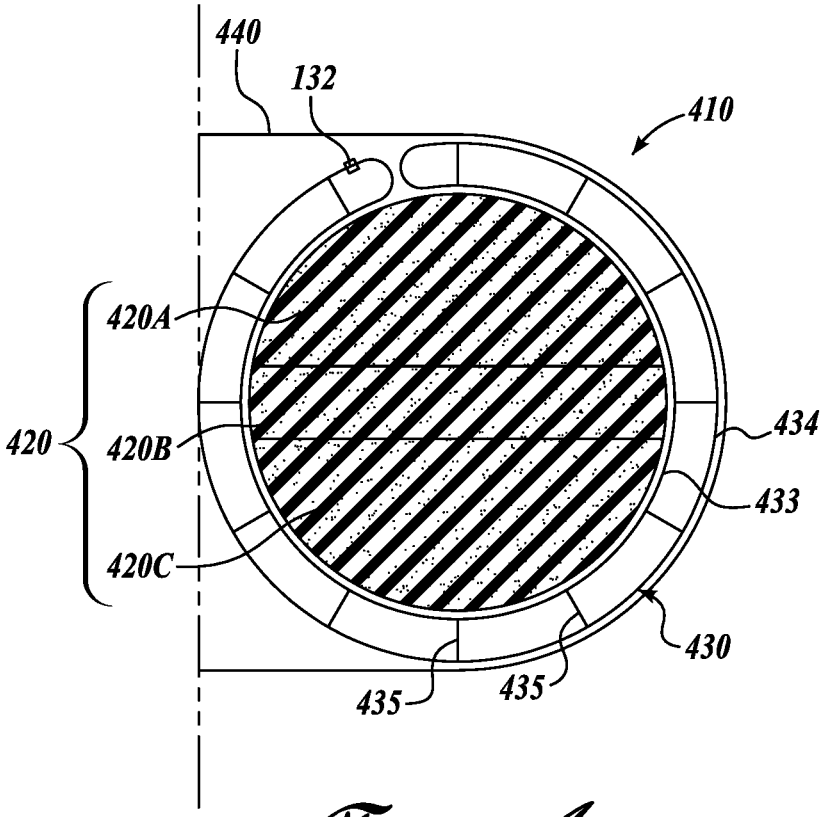
FIG. 6A is a cross-sectional view near one end of another embodiment of an outboard stabilizer in accordance with the present invention.
Figure 6B:
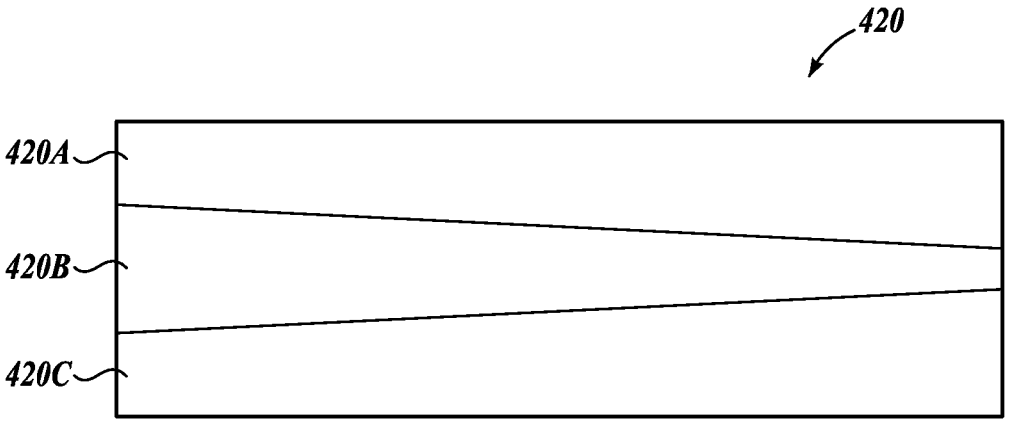
FIG. 6B is a side view of the multi-part foam core member of the outboard stabilizer shown in FIG. 6A.

FIG. 6A illustrates a cross section of another embodiment of a stabilizing member 410 in accordance with the present invention. In this embodiment, the foam core member 420 is formed in three elongate members 420A, 420B, 420C. FIG. 6B is a side view of the foam core member 420 shown in isolation. In this embodiment, the center elongate member 420 is generally wedge-shaped, to facilitate removal of the foam core member 420.

A bladder 430 is configured to substantially encircle the foam core member 420. The bladder 430 includes an inner wall portion 433 and an outer wall portion 434 that cooperatively define the bladder volume. A plurality of substantially inelastic internal joining members 435 connect the inner and outer wall portions 433, 434 and are configured to prevent the inner wall portion from exerting a significant compressive force on the foam core member 420 when the bladder 430 is pressurized. A sheath 440 for connecting the stabilizing member 410 to the watercraft is also provided, similar to the sheath assembly 340 discussed above.

The relative sizes of the foam members and bladders for the outboard stabilizing members 110, 210, 310, 410 disclosed herein may be selected to provide desired characteristics in the watercraft 100. For example, in some applications relatively larger bladders may be preferred to "soften" the ride characteristics of a watercraft 100. In other applications relatively larger foam members may be preferred to optimize the floatation characteristics if the bladder is punctured.

An additional advantage of some embodiments of the present invention is that the same mounting and sheath assembly 340 may be used with different foam core and bladder assemblies. For example, in the stabilizer assembly 410 shown in FIGS. 6A and 6B a larger foam core 420 may be used in the sheath assembly 440 with a smaller bladder 430 in one configuration, and a smaller foam core 420 may be used with a larger bladder 430 in an alternative configuration. This novel feature allows a user to modify a particular watercraft configuration by simply replacing one foam core/bladder combination with a different but corresponding foam core/bladder assembly, to change the watercraft characteristics without any other changes.

While illustrative embodiments have been illustrated and described, it will be appreciated that various changes can be made therein without departing from the spirit and scope of the invention.

The embodiments of the invention in which an exclusive property or privilege is claimed are defined as follows:

1. An outboard stabilizing member for a watercraft comprising:

an elongate foam core having an outer surface; and a first inflatable bladder comprising an inner wall portion, an outer wall portion, and a plurality of connecting members located at spaced locations along the inner and outer wall portions that connect the inner wall portion to the outer wall portion, wherein the inner wall portion is configured to overlie at least a portion of the outer surface of the foam core;

wherein when the inflatable bladder is inflated to a design pressure between 1 psig and 40 psig, the plurality of connecting members connecting the inner wall portion to the outer wall portion prevent the inner wall portion from applying a compressive force to the foam core, and further wherein the plurality of inelastic connecting members comprise a plurality of panels.

2. The outboard stabilizing member of claim 1, further comprising a sheath that is configured to cover the inflatable bladder, and to removably attach the stabilizing member to the watercraft.

3. The outboard stabilizing member of claim 1, wherein the plurality of panels define a plurality of channels in the bladder that are in fluid communication.

4. The outboard stabilizing member of claim 1, wherein the plurality of inelastic members comprise webbing extending between the inner wall portion and the outer wall portion.

5. The outboard stabilizing member of claim 1, wherein the plurality of inelastic connecting members further comprise a plurality of strings or rods.

6. The outboard stabilizing member of claim 5, wherein the plurality of strings or rods are evenly spaced throughout the bladder.

7. The outboard stabilizing member of claim 5, wherein the plurality of strings or rods have a uniform length, such that the plurality of strings or rods maintain a constant spacing between the inner wall portion and the outer wall portion.

8. The outboard stabilizing member of claim 1, wherein the foam core comprises a plurality of elongate foam sub-members that extend from a first end of the foam core to a second end of the foam core.

9. The outboard stabilizing member of claim 8, wherein at least one of the plurality of foam sub-members is wedge-shaped.

10. The outboard stabilizing member of claim 1, wherein the foam core comprises an elongate foam core having a D-shaped cross section.

11. An outboard stabilizing member for a watercraft comprising:

an elongate foam core having an outer surface; and a first inflatable bladder comprising an inner wall portion, an outer wall portion, and a plurality of connecting members located at spaced locations along the inner and outer wall portions that connect the inner wall portion to the outer wall portion, wherein the inner wall portion is configured to overlie at least a portion of the outer surface of the foam core;

wherein when the inflatable bladder is inflated to a design pressure between 1 psig and 40 psig, the plurality of connecting members connecting the inner wall portion to the outer wall portion prevent the inner wall portion from applying compressive force to the foam core; and further comprising a second inflatable bladder comprising an inner wall portion, an outer wall portion, and a plurality of connecting members that connect the inner wall portion to the outer wall portion and wherein the second inflatable bladder is configured to be inflated to the design pressure without applying a compressive force to the foam core.

12. The outboard stabilizing member of claim 11, wherein the first and second inflatable bladders are configured to be positioned on opposite sides of the foam core.

13. The outboard stabilizing member of claim 1, wherein the bladder is configured to encircle the foam core.

14. A watercraft having a starboard stabilizing member and a port stabilizing member, wherein the port and starboard stabilizing members comprise the outboard stabilizing member of claim 1.

15. A high-performance watercraft comprising:

a planing hull having a port side sheet and a starboard side sheet;

at least one motor attached to the hull;

a port stabilizing member attached to an outboard side of the port side sheet;

a starboard stabilizing member attached to an outboard side of the starboard side sheet;

wherein each of the port and starboard stabilizing members comprise:

an elongate foam core having an outer surface; and a first inflatable bladder comprising an inner wall portion, an outer wall portion, and a plurality of connecting members located at spaced locations along the inner and outer wall portions that connect the inner wall portion to the outer wall portion, wherein the plurality of inelastic connecting members comprise a plurality of panels, and wherein the inner wall portion is configured to overlie at least a portion of the outer surface of the foam core; and wherein when the inflatable bladder is inflated to a design pressure between 1 psig and 40 psig, the plurality of connecting members connecting the inner wall portion to the outer wall portion prevent the inner wall portion from producing a significant compressive force to the foam core.

16. The high-performance watercraft of claim 15, wherein each of the port stabilizing member and the starboard stabilizing member further comprises a sheath that is configured to cover the inflatable bladder, and is further configured to removably attach the stabilizing member to the watercraft.

17. The high-performance watercraft of claim 15, wherein the plurality of connecting members comprise a plurality of strings or rods.

* * * * *